US005434393A

United States Patent [19]

Jurkofsky

[11] Patent Number: 5,434,393

[45] Date of Patent: Jul. 18, 1995

[54] MICROWAVE COOKING BAG WITH EXTENSION AS HANDLING VEHICLE

[76] Inventor: Maryann Jurkofsky, 2425 Bull St., Savannah, Ga. 31401

[21] Appl. No.: 969,926

[22] Filed: Oct. 30, 1992

Related U.S. Application Data

[63] Continuation of Ser. No. 569,625, Oct. 9, 1990, abandoned.

[51] Int. Cl.[6] ..... H05B 6/80

[52] U.S. Cl. ..... 219/734; 219/725; 219/735; 99/DIG. 14; 426/107; 426/113; 426/234; 426/243

[58] Field of Search ..... 219/725, 730, 731, 735, 219/734; 99/DIG. 14, 358; 426/107, 113, 234, 243; 383/126; 206/459

[56] References Cited

U.S. PATENT DOCUMENTS

| | | | |
|---|---|---|---|
| 2,528,251 | 10/1950 | Spencer | 426/107 |
| 4,042,110 | 8/1977 | Guernsey | 206/459 |
| 4,100,302 | 7/1978 | Theimer et al. | 99/358 |
| 4,316,070 | 2/1982 | Prosise et al. | 219/730 |
| 4,734,288 | 3/1988 | Engstrom et al. | 426/107 |
| 4,810,844 | 3/1989 | Anderson | 219/730 |
| 4,864,090 | 9/1989 | Maxwell et al. | 219/730 |
| 5,011,299 | 4/1991 | Black, Jr. et al. | 219/730 |

*Primary Examiner*—Bruce A. Reynolds
*Assistant Examiner*—Tu Hoang

[57] ABSTRACT

Microwave cookware of flexible, transparent material displaying an expandable bottom and two opposing walls, one wall containing an aperture, the other opposing wall displaying an extension, the objective being to manually pull the extension through the aperture rendering the bag closed and, vented, leaving the extension as a handling vehicle.

2 Claims, 1 Drawing Sheet

MICROWAVE COOKING BAG WITH EXTENSION AS HANDLING VEHICLE

This application is a continuation of Ser. No 07/569,625, filed Oct. 9, 1990, now abandoned.

BACKGROUND

Many patents have been issued for flexible cookware to be used in a microwave oven. It has been found that much of this cookware is only available in microwave ready packages and as such requires additional members or special devices be added to the configuration to provide for filling the cookware, sealing it shut or, providing for a venting or handling mechanism. These microwave ready packages most often pre-package the comestible inside. This pre-packaging tends to limit the comestible to being either frozen or vacuum packaged with a dated shelf life. As a result, much of the cookware has become complex and costly and limits the choice of comestibles.

Prosise et al. U.S. Pat. No. 4,316,070 Feb. 16, 1982 describes the use of a vented enclosure surrounded by a liquid inner layer which surrounds the cooking comestible.

Anderson U.S. Pat. No. 4,810,844 Mar. 7, 1989 describes edible popcorn being placed inside the bag after which the upper edges of side panels are joined in a seam, it being advantageous, this seam should be made to open partially during the cooking process. It is indicated that the closing seam be specially configured to allow vapor pressure release by applying a heat seal or water sensitive adhesive in a pattern which provides weak spots.

Engstrom et al. U.S. Pat. No. 4,734,288 Mar. 28, 1988 describes a package of an expandable food pouch within a container. The expandable food pouch employing a designed fault along its peripheral edge to facilitate the controlled release of pressure formed within the pouch.

McHam U.S. Pat. No. 4,292,332 utilizes an expandable container comprising a closed bag of flexible sheet material having its upper side provided with a pattern of weakness that serves as an excessive vapor pressure release.

Cage et al. U.S. Pat. No. 4,571,337 discloses a bag for cooking popcorn in a microwave oven in which the top edge seal opens before popping is completed to release steam and prevent the popcorn from becoming too heavy.

Black Jr. et al. U.S. Pat. No. 5,011,299 Apr. 30, 1991 describes the construction of a bag with a fin like extension secured by heat sensitive adhesive allowing the extension to expand which seems to improve the microwave cooking operation. The popcorn kernels are inserted into the interior of the bag through an open top end after which the top end is heat sealed.

Maxwell et al. U.S. Pat. No. 4,864,090 Sep. 5, 1989 describes a package in which a second portion constituting a flap that extends during the cooking process and remains quite cool so it may be grasped to effect safe handling.

Spencer U.S. Pat. No. 2,528,251 describes a recepticle in which the comestible is pre-sealed within, then, utilizing a member added to the configuration, allows one to get a firm grip on. A ripcord is also incorporated into the configuration of the cookware which is grasped and pulled resulting in tearing or ripping of the bag.

SUMMARY

While all of these previously mentioned patents utilize various methods for closing, venting, handling and opening the cookware, none allows for the manual performance of all of those functions necessary to render the cookware filled, with a comestible of choice, and handling vehicle ready for a microwave cooking operation.

As an improvement of the cookware that presently exists in the prior art, the present invention brings to flexible, transparent cookware in the form of a storage type bag which can be manually activated whenever a microwave cooking operation is desired.

One objective of this invention is to allow choice of the desired comestible to be cooked.

Another objective is to employ a manual closing mechanism that will close, vent and produce a handle for the cookware by employing a single-step operation.

Yet another objective is that the configuration be such that the use of additional members, heat sensitive devices or the like normally employed for closing, venting handling or opening the cookware are eliminated.

BRIEF DESCRIPTION OF DRAWINGS

FIG. I shows the configuration of the cookware in accordance with the invention in an open position containing an ear of corn in a condition of preparation for a microwave cooking operation.

FIG. II shows a side view of the cookware and indicates the operation of the closure.

Figure 1:
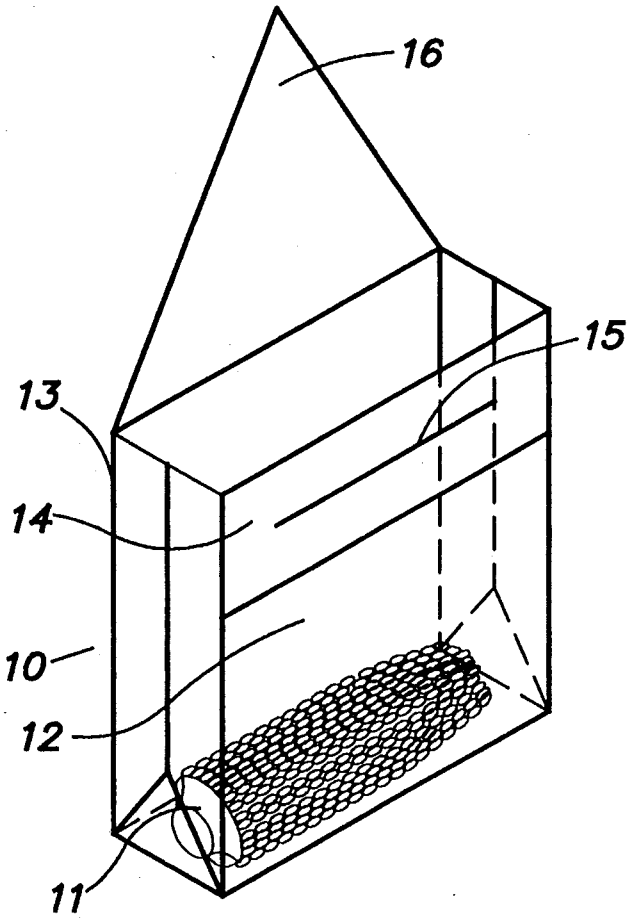
Figure 2:
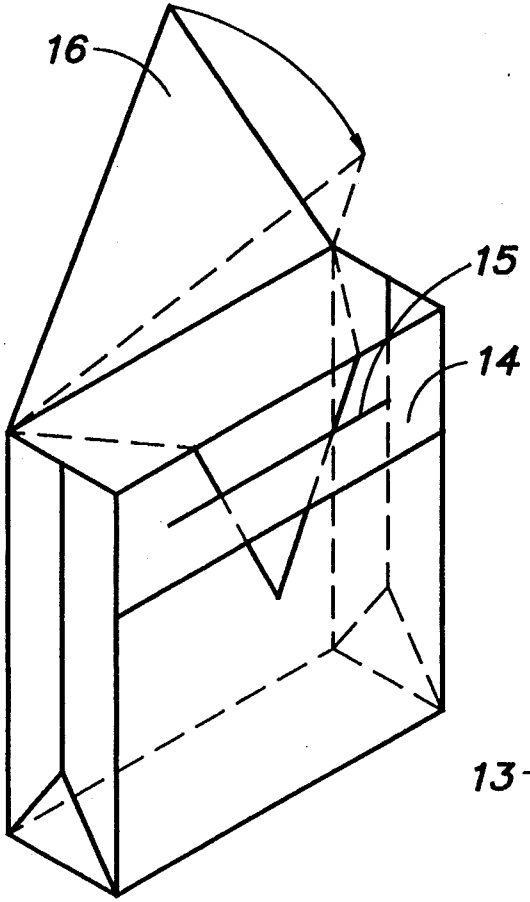
Figure 3:
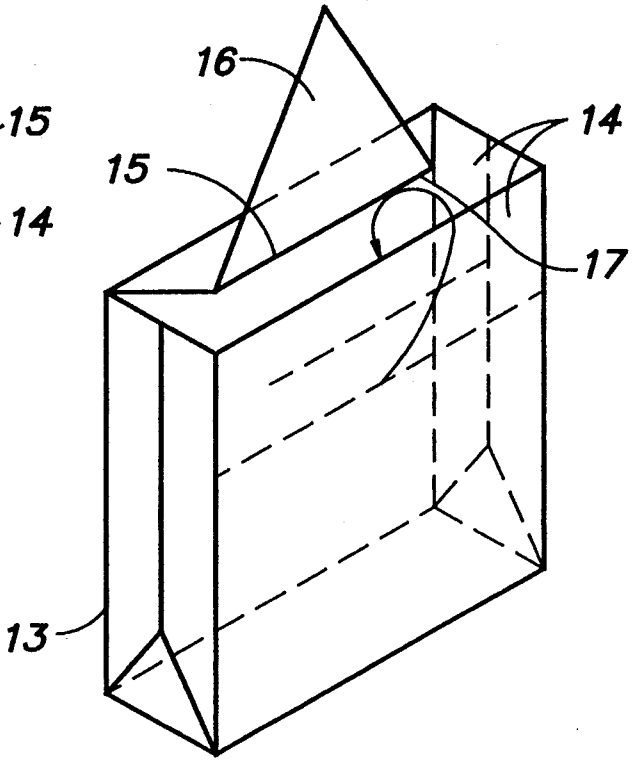

FIG. III shows the cookware after the closure has been activated ready for a microwave cooking operation.

DESCRIPTION OF THE PREFERRED EMBODIMENT

Illustrated in FIG. I an item of microwave energy cookware in the form of a bag (10) containing a quantity of food (ear of corn), this said bag (10) displaying a gusseted bottom (11), two opposing walls (12) and (13), one of these walls (12) having a folded back panel (14), said folded back panel (14) containing an aperture (15), the other opposing wall (13) being constructed as having an extension (16).

The cookware in the preferred embodiment (FIG. I) is made from an intucked flat bag tube which may be made by one of the automatic bag making machines well known in the art. The same machine is also capable of making the aperture (15) in the folded back panel (14). The extension (16) located on one wall (13) of the bag (10) can also be made to a configuration which will allow it to be easily pulled through the aperture (15).

The cookware generally displays a rectangular shape although variations are possible. The material from which the cookware is formed must be flexible, substantially transparent to microwave energy and should be able to withstand the high temperature reached during the microwave cooking process, particularly when comestibles containing flat, such as a hamburger, or comestibles requiring the addition of fat, such as popcorn, are being cooked. A variety of polyethylene or polypropylene films currently available would be suitable for this purpose.

FIG. II illustrates the manual operation of the closure wherein the extension (16) is pulled through the aperture (15) located in the folded back panel (14). This action causes the folded back panel (14) to overlap the opposing wall (13). This now leaves the bag (10) in a closed position; but, allows the aperture (15) to function as a pre-opened venting mechanism for the bag (10) the improvement being no special or additional devices were necessary to accomplish the venting or closing process. In addition, the same action that renders the bag closed and vented, also allows the extension (16) to be utilized for handling purposes eliminating additional mechanisms normally employed for this purpose.

FIG. III illustrates the closed bag (10) displaying the folded back panel (14) having overlaped the wall (13) with the aperture (15) now functioning as an open venting mechanism and the extension (16) now functioning as a handling vehicle the improvement being manual control of all functions necessary to render the bag (10) ready for a microwave cooking operation with a handling vehicle is achieved, an option not normally available in previous patents. In addition, once the comestible has been cooked, the cookware is opened by reversing the action of the closing process allowing the closing mechanism to be employed in a dual function eliminating the necessity of an additional opening mechanism. It is contemplated that various modifications of the preferred embodiment could be made without deviating from the spirit of the invention.

We claim:

1. A microwave cooking bag of flexible, transparent material with expansion capabilities comprising a gusseted bottom and two opposing walls, wherein one of said walls having a folded back panel, said folded back panel containing an aperture, the other opposing wall of said bag having an extension, said extension being configured as to allow said extension to be manually pulled through said aperture for causing said extension to overlap and communicate with the wall having said folded back panel and leaving said aperture to function as a pre-opened venting mechanism and said extension to function as a handling vehicle.

2. The microwave cooking bag of claim 1, in which said material is of a flexible, light transparent material which is substantially transparent to microwave energy and capable of withstanding microwave cooking temperatures.

* * * * *